United States Patent [19]

Cress et al.

[11] Patent Number: 4,843,680

[45] Date of Patent: Jul. 4, 1989

[54] HINGE PARTICULARLY ADAPTED FOR USE WITH A FALSE CABINET FRONT

[75] Inventors: David R. Cress, Janesville; Eddie D. Ellenberger, Beloit, both of Wis.

[73] Assignee: Amerock Corporation, Rockford, Ill.

[21] Appl. No.: 263,816

[22] Filed: Oct. 28, 1988

[51] Int. Cl.[4] ..... E05D 7/04

[52] U.S. Cl. ..... 16/289; 16/237; 16/358; 16/360; 16/369; 16/370; 16/371; 16/387

[58] Field of Search ..... 16/358, 360, 368, 370, 16/294, 289, 286, 287, 288; 220/332, 333; 312/325

[56] References Cited

U.S. PATENT DOCUMENTS

| | | | |
|---|---|---|---|
| 4,729,616 | 3/1988 | Vogt | 220/333 |
| 4,736,491 | 3/1988 | Mertes | 16/358 |
| 4,756,054 | 7/1988 | Mitts et al. | 16/368 |

*Primary Examiner*—Nicholas P. Godici
*Assistant Examiner*—Edward A. Brown
*Attorney, Agent, or Firm*—Leydig, Voit & Mayer, Ltd.

[57] ABSTRACT

A hinge for mounting a false front for swinging between closed and open positions on a cabinet. The hinge includes first and second mounting brackets adapted to be secured to the false front and the cabinet, respectively. A first link has one end pivotably and slidably connected to the first bracket and an opposite end pivotably connected to the second bracket. A second link is pivotably connected between its ends to the first link, has one end pivotably connected to the first bracket, and has an opposite end pivotably and slidably connected to the second bracket. The hinge permits the false front and a tray thereon to be opened to an easily accessible position and enables the false front to be located between and closely adjacent to the countertop and the doors of the cabinet.

9 Claims, 3 Drawing Sheets

HINGE PARTICULARLY ADAPTED FOR USE WITH A FALSE CABINET FRONT

BACKGROUND OF THE INVENTION

In general, this invention relates to a hinge for mounting a closure member for swinging between open and closed positions relative to a fixed member. While the hinge of the invention will find many applications, it is particularly useful in attaching a so-called false front to a lower kitchen cabinet.

A false front is a member which is located at the upper front portion of a cabinet just above the doors of the cabinet and just below the countertop. The false front usually is associated with a cabinet for a sink and its inner side usually carries a tray for storing different items such as scrub pads, brushes or the like. False fronts also are used with bathroom vanities.

To enable access to the items in the tray, the false front is hinged to the cabinet so as to be capable of swinging downwardly and outwardly from an upright closed position to a vertically inclined open position. A hinge is located at each end of the false front and is attached to the cabinet in order to mount the false front for swinging between its closed and open positions. Mitts et al U.S. Pat. No. 4,756,054 discloses a hinge which is especially designed for use with a false front for a cabinet.

SUMMARY OF THE INVENTION

The primary aim of the present invention is to provide a new and improved hinge which, when used with a false cabinet front, permits the front to be opened to a position enabling more convenient access to the items in the tray which is carried by the false front.

Another object of the invention is to provide a hinge which permits the false front to be mounted in very close proximity to the tops of the cabinet doors and to the underside of the cabinet countertop.

Still a further object is to provide a hinge which permits the false front to open smoothly and without binding even though the false front is pulled open only from one end.

The invention also resides in the provision of a hinge having pivotable and slidable links which are uniquely arranged and guided in order to achieve the foregoing objects.

Further, the invention is characterized by novel bushings which support the links for pivoting and sliding, which enable the hinge to operate quietly and which facilitate easy assembly of the components of the hinge.

These and other objects and advantages of the invention will become more apparent from the following detailed description when taken in conjunction with the accompanying drawings.

DETAILED DESCRIPTION OF THE PREFERRED EMBODIMENT

Figure 1:
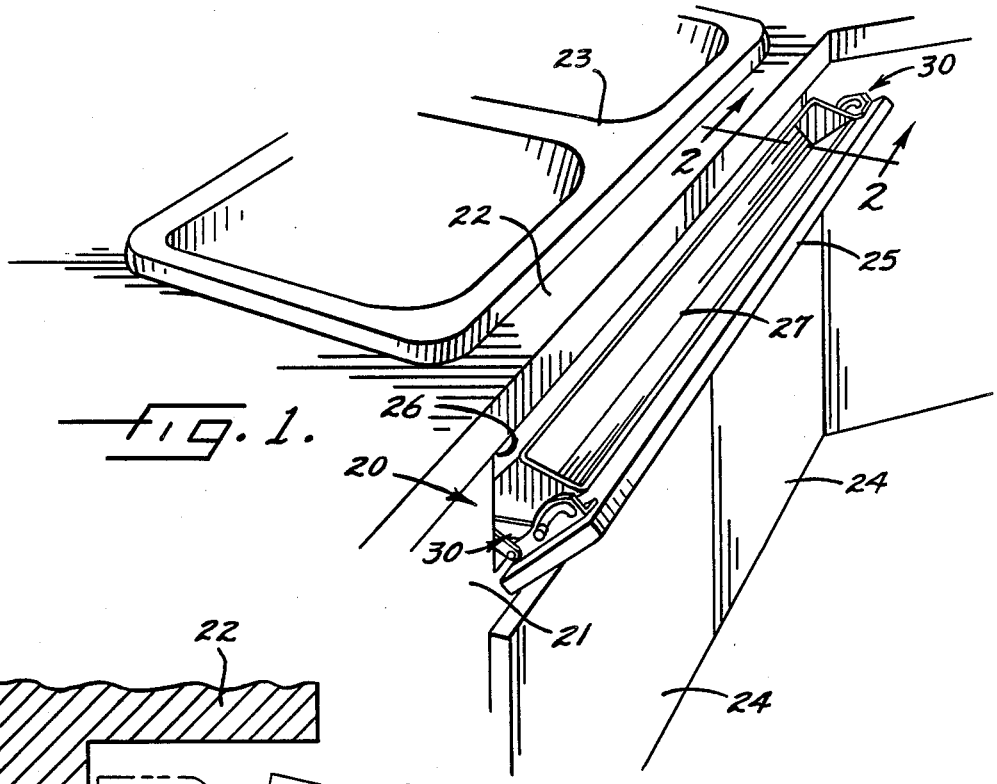
FIG. 1 is a perspective view of a typical cabinet having a false front which is swingably mounted by new and improved hinges incorporating the unique features of the present invention, the false front being shown in a fully open position.

For purposes of illustration, the invention has been shown in the drawings in conjunction with a kitchen cabinet 20 having a fixed base member 21, a countertop 22 supported by the base 21, a sink 23 located in the countertop 22, two hinged doors 24, and a closure member in the form of a false front 25 located just above the upper edges of the doors and just below the forward edge portion of the countertop. The false front is adapted to close a long and comparatively narrow rectangular opening 26 which is formed through the upper end portion of the base 21. A tray 27 for holding kitchen items is attached to the rear side of the false front 25. When the false front is upright and is in a closed position shown in FIG. 3, the tray 27 is disposed in the opening 26 and extends rearwardly into the base. When the false front is pulled downwardly and outwardly away from the base to an open position (FIGS. 1 and 2), the tray moves out of the base to enable access to th items in the tray.

The false front 25 is supported on the base 21 to swing between its closed and open positions by a pair of hinges 30, there being one hinge at each end of the false front. The two hinges are identical in principle and differ from one another only to the extent necessary to enable one hinge to be installed at the left end of the false front and to enable the other hinge to be installed at the right hand of the false front. Only the right hinge has been shown in detail in the drawings.

The present invention contemplates the provision of a new and improved false front hinge 30 which enables the false front to be moved downwardly and outwardly from the base 21 to a position in which the articles in the tray 27 are very easily accessible. In addition, the hinge permits the upper and lower edges of the false front to be located closely adjacent the underside of the countertop 22 and the upper edges of the doors 24, respectively, so that unattractive gaps of substantial width may be avoided. The hinge of the invention also enables the false front to be opened easily even though the pulling force may be applied only to one end portion of the front and not to the center or both end portions of the front.

Figure 2:
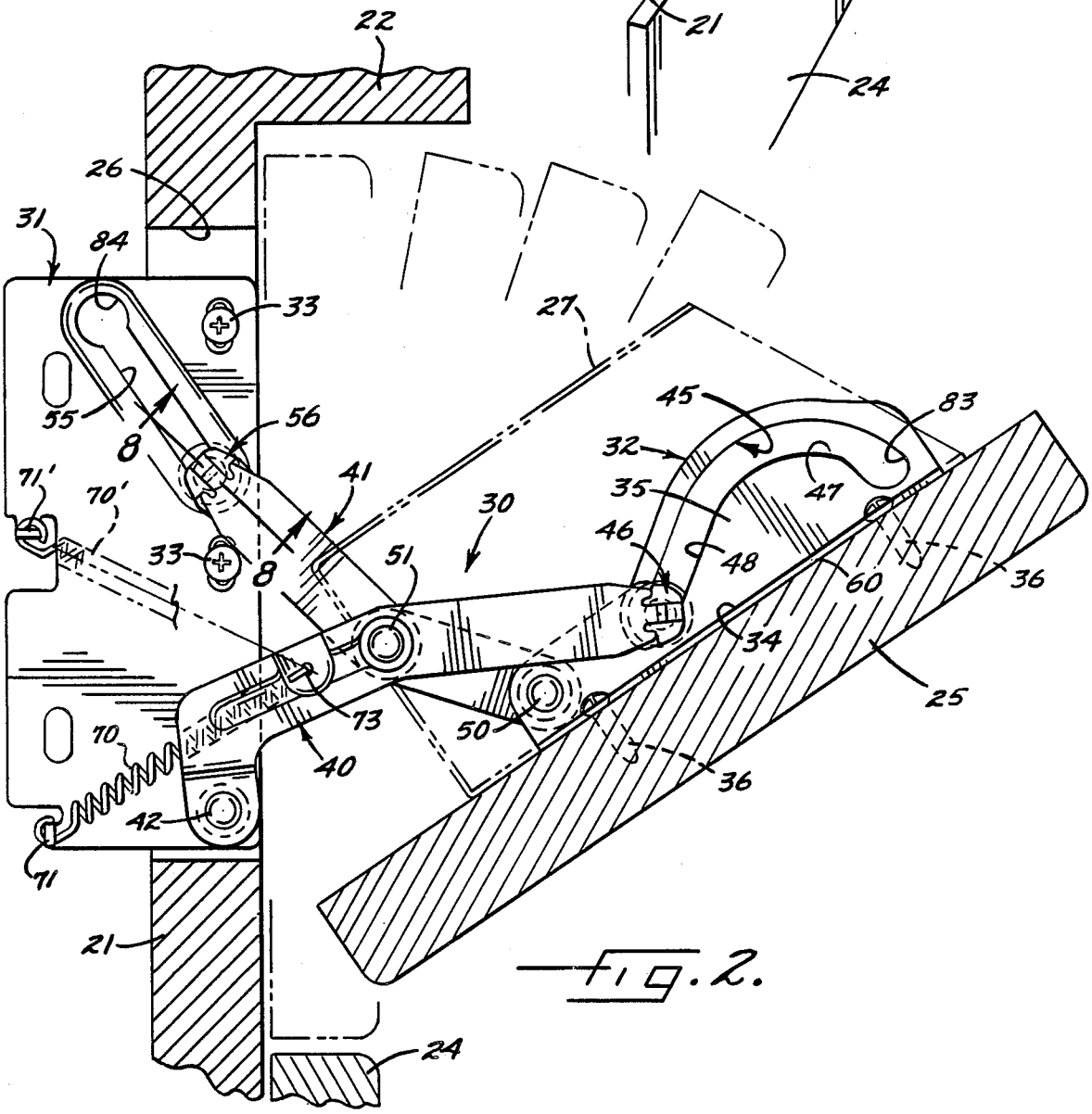
FIG. 2 is an enlarged fragmentary cross-section taken substantially along the line 2—2 of FIG. 1.

More specifically, the hinge 30 includes a fixed mounting bracket 31 and a movable mounting bracket 32. The fixed bracket 31 is a flat plate which is located in the opening 26 at one end thereof and which is secured to the base 21 by screws 33. The bracket 31 is disposed in a vertical plane which extends perpendicular to the front of the base. As shown in FIG. 2, the forward edge of the bracket 31 is in the same vertical plane as the front side of the opening 26 and thus is located at the interface between the base 21 and the false front 25.

Figure 4:
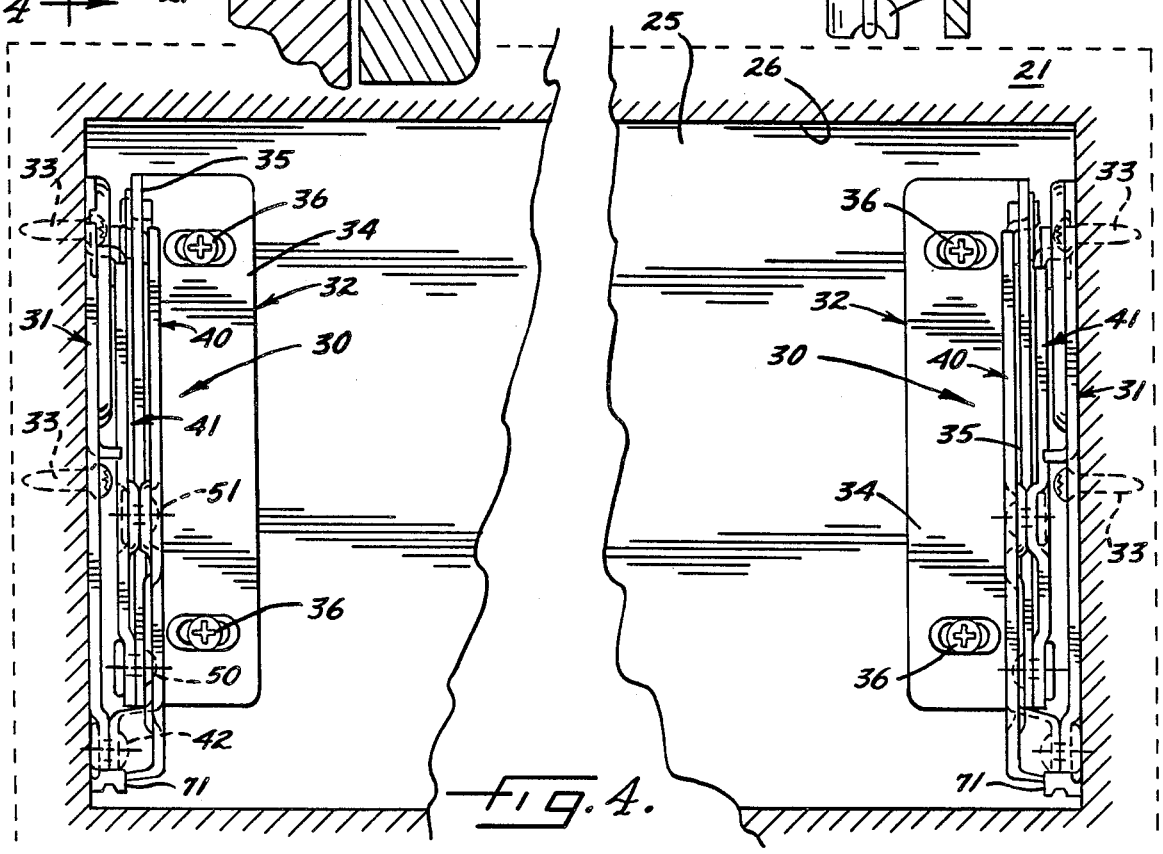
FIG. 4 is an elevational view of the inner side of the false front and the hinges, the view being taken along the line 4—4 of FIG. 3.
Figure 6:
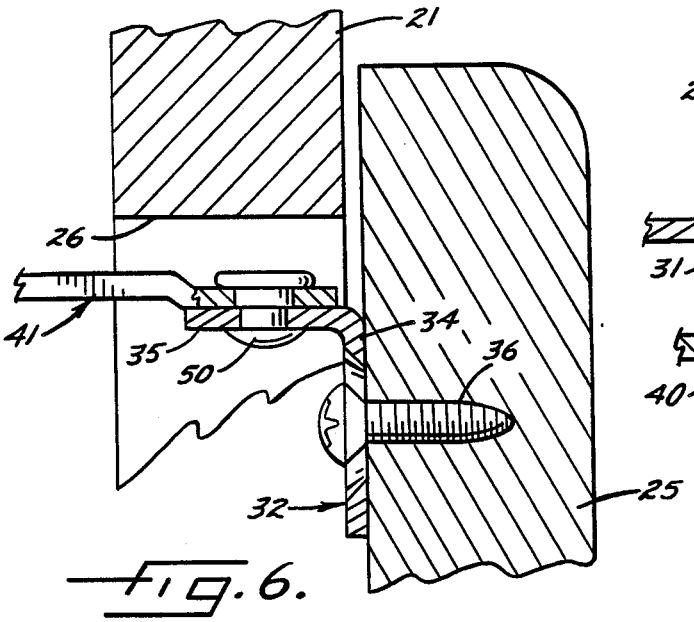
Figure 7:
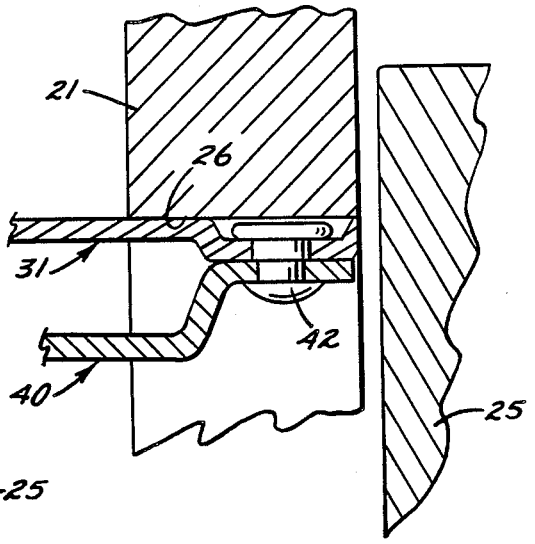

The bracket 32 includes two integral plates 34 and 35 which are disposed at right angles to one another. As is apparent from FIGS. 2 and 4, the plate 34 is in face-to-face engagement with the inner or rear side of the false front 25 and is anchored to one end portion of the false front by screws 36. When the false front is in its closed position the plate 35 of the bracket 32 is located within the opening 26 and is spaced laterally from the bracket 31 in parallel relation therewith.

In carrying out the invention, the hinge 30 comprises two links 40 and 41 which hingedly support the bracket 32 to swing relative to the bracket 31. The link 40 is generally L-shaped and includes a lower end portion which is pivotally connected by a rivet 42 to the lower end portion of the bracket 31. The rivet supports the link 40 for swinging relative to the bracket 31 about a fixed horizontal axis extending longitudinally of the opening 26.

Figure 3:
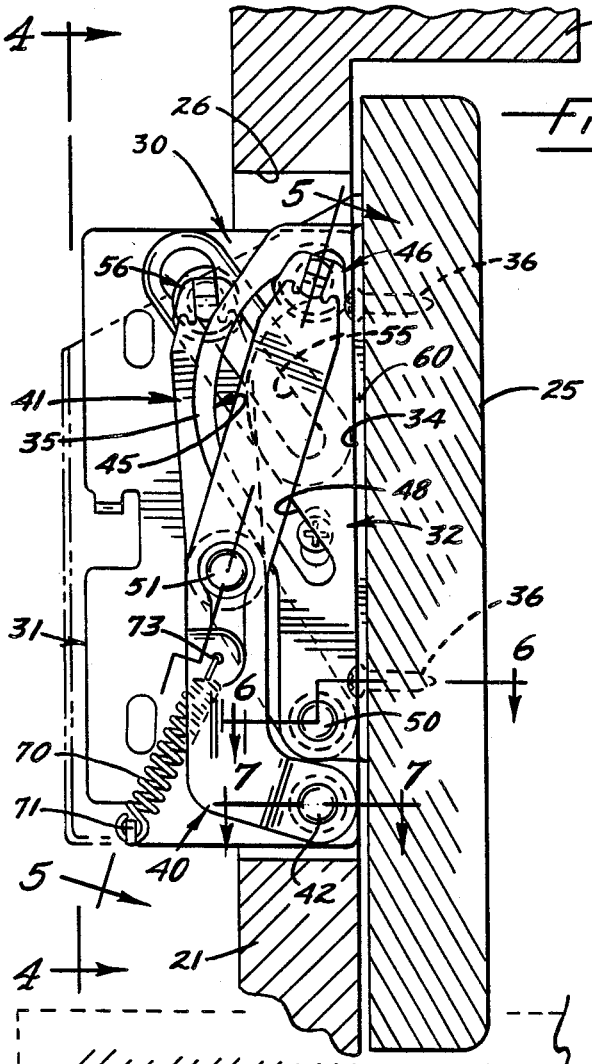
FIG. 3 is a view similar to FIG. 2 but shows the false front in its fully closed position.
Figure 5:
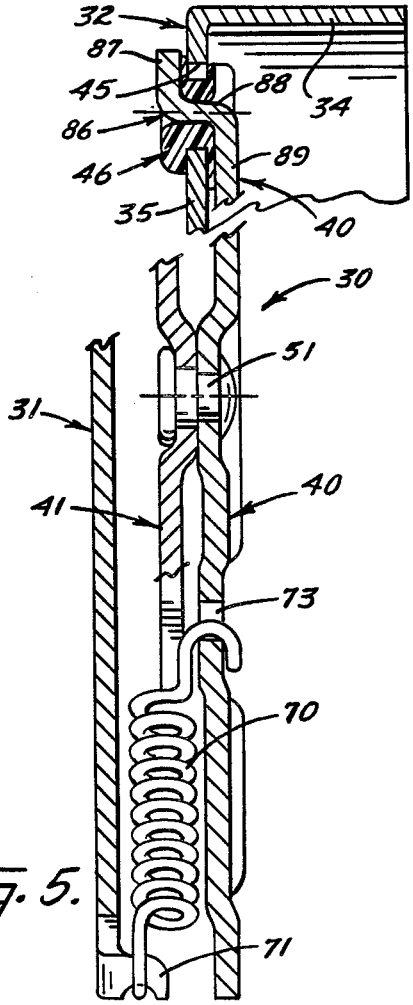
FIGS. 5, 6 and 7 are enlarged fragmentary crosssections taken substantially along the lines 5—5, 6—6 and 7—7, respectively, of FIG. 3.

At its upper end, the link 40 is connected slidably and pivotably to the plate 35 of the bracket 32. To this end, a slot 45 is formed through the plate 35 and pivotably and slidably receives a pivot member 46 on the upper end portion of the link 40. The slot 45 includes an arcuate portion 47 located approximately in the upper half of the plate 35 and further includes a straight portion 48 which extends downwardly and outwardly from the lower end of the arcuate portion when the false front 25 is in its closed position (FIG. 3).

The second link 41 of the hinge 30 is generally in the shape of a shallow V. At its lower end portion, the link 41 is pivotably connected to the lower end portion of the plate 35 of the bracket 32 by a rivet 50 which extends parallel to the rivet 42. Between its ends, the link 41 is pivotably connected to the link 40 by a horizontal rivet 51 located approximately midway between the ends of the link 40.

The upper end portion of the link 41 is pivotably and slidably connected to the upper end portion of the bracket 31. For this purpose, a straight slot 55 (FIG. 2) is formed in the upper end portion of the bracket 31 and pivotably and slidably receives a pivot member 56 on the upper end portion of the link 41. When the false front 25 is in its closed position, the slot 55 extends generally parallel to a straight line extending between the rivets 50 and 51 (see FIG. 3). When the false front is fully closed, the straight portion 48 of the slot 45 also extends generally parallel to the slot 55. The curved portion 47 of the slot 45 is arcuate and is curved about a center point 60 (FIG. 3) which, when the false front 25 is closed, is located in a vertical plane lying substantially along the innerface between the rear side of the false front and the front side of the base 21. Within that plane, the center point 60 is disposed in a horizontal plane located between the pivot member 46 and the rivet 51. The radius of the curved portion 47 of the slot 45 is equal to approximately one-fourth the distance between the pivot member 46 and the rivet 42. The combined active length of the curved and straight portions 47 and 48 of the slot 45 is equal to about twice the active length of the slot 55.

The hinge 30 is completed by a contractile spring 70 (FIG. 2) which is stretched between a tab 71 on the mounting bracket 31 and a hole 73 in the link 40. The spring urges the link 40 counterclockwise about the rivet 42 and thus biases the false front 25 to its closed position. By attaching the spring to a tab 71' about midway along the height of the bracket 31, the closing force exerted on the false front by the spring may be increased. The reference numeral 70' in FIG. 2 designates the alternate position of the spring.

When the false front 25 is fully closed, the various components of the hinge 30 are positioned as shown in FIG. 3. In this position, the two links 40 and 41 are collapsed into a scissored relationship and are located such that the pivot member 46 is in the upper end portion of the slot 45 while the pivot member 56 is located adjacent the upper end portion of the slot 55.

When the false front 25 is pulled open, the components of the hinge 30 move from the position shown in FIG. 3 to the position shown in FIG. 2. During such movement, the link 40 pivots about the rivet 42 and relative to the bracket 31, pivots about the rivet 51 relative to the link 41, and slides and pivots relative to the bracket 32 by virtue of the slot 45 and the pivot member 46. During initial opening, the pivot member 46 rides in the curved portion 47 of the slot 45 and, after the false front 25 has been opened through an angle of about forty degrees, rides in the straight portion 48 of the slot.

As the false front 25 opens, the link 41 pivots relative to the bracket 32 as permitted by the rivet 50, turns relative to the link 40 as permitted by the rivet 51, and pivots and slides relative to the bracket 31 as permitted by the straight slot 55 and the pivot member 56. The pivot member 56 slides downwardly and outwardly in the slot 55 and bottoms against the lower end of the slot when the false front 25 has been opened through an angle of about 55 degrees. The pivot member 46 bottoms against the lower end of the straight portion 48 of the slot 45 at the same time the pivot member 56 bottoms against the lower end of the slot 55.

Because of the manner in which the links 40 and 41 coact with one another and with the brackets 31 and 32, the false front 25 does not swing in a true arc as it moves from its closed position toward its open position. Instead, the false front moves in a rather flat path as shown in phantom lines in FIG. 2. As a result, the top edge of the false front can be located closely adjacent the underside of the countertop 22 without interference occurring during opening and closing. Also, the opening motion shifts the false front in such a manner that the tray 27 is pulled well clear of the cabinet base 21 thereby to allow easy and convenient access to the items in the tray. During such movement, the lower edge of the false front shifts upwardly away from the upper edge of the cabinet doors 24 so as to avoid interference between the false front and the doors.

When the false front 25 has been opened through an angle of about 35 degrees, the weight of the false front begins to balance the force of the spring 70 and thus the false front moves to and is retained in its open position by its own weight. The spring, however, does exert a continuous restraining force and thus prevents the false front from clunking into its open position. When the false front is returned to about its 35 degree position, the spring swings the false front to its fully closed position so that the hinge 30 thus is self-closing. The links 40 and 41 are arranged such that, even if the spring 70 breaks, the links themselves tend to hold the false front 25 in its closed position. The links also operate very smoothly and quietly and promote smooth opening and closing of the false front even though manual force is applied only to one end of the false front.

According to a detailed aspect of the invention, each of the pivot members 46 and 56 is of a unique construction permitting easy assembly of the links 40 and 41 to the brackets 31 and 32, respectively. Herein, each pivot member is in the form of a bushing made of hard antifriction plastic and having a central hub 80 (FIG. 9) and a pair of radially projecting and axially spaced flanges 81 and 82. The extreme upper ends of the slots 45 and 55 are enlarged as indicated at 83 and 84, respectively, in FIG. 2 and enable the bushings 46, 56 to be inserted into the slots with the flanges 81 and 82 located on opposite faces of the respective brackets.

Figure 8:
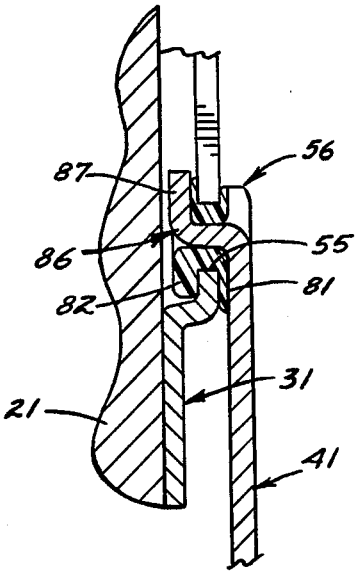
FIG. 8 is an enlarged fragmentary cross-section taken substantially along the line 8-8 of FIG. 2 and shows one of the links and one of the bushings of the hinge.
Figure 9:
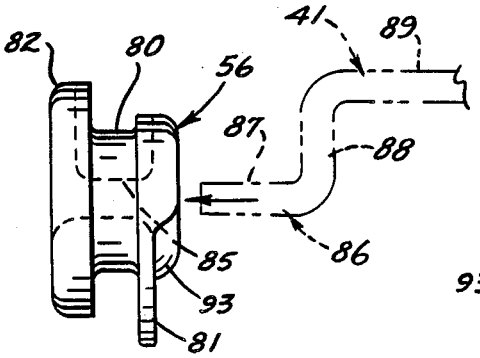
FIG. 9 is an enlarged exploded view of the link and the bushing shown in FIG. 8.
Figure 10:
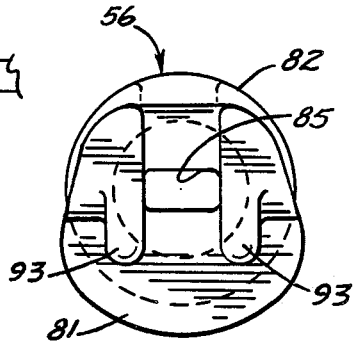
FIG. 10 is a side elevational view of the bushing shown in FIG. 9.

Formed through the hub 80 of each bushing 46, 56 is a hole 85 of rectangular cross-section for receiving a similarly shaped connector 86 integral with the appropriate end of the associated link 40, 41. Each connector is generally S-shaped and includes a first leg 87 at the extreme free end of the link, a bridge 88 extending perpendicular to the leg 87, and another leg 89 extending from the bridge 88 in a direction opposite of the leg 87. By turning the link as shown in FIG. 9 and moving the link endwise, the leg 87 may be inserted through the hole 85. Thereafter, the link is turned 90 degrees to the position shown in FIG. 8. This positions the legs 87 and 89 on opposite sides of the bushing and retains the link in place.

Figure 11:
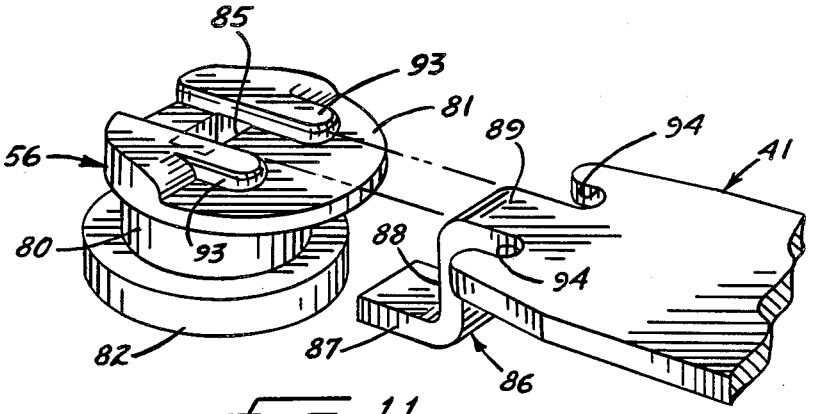
FIG. 11 is an enlarged exploded perspective view of the link and the bushing shown in FIG. 8.

Means are provided for locking the links 40, 41 against turning relative to the bushings 46, 56, respectively. Herein, these means comprise two fingers 93 (FIG. 11) molded integrally with the inboard flange 81 of the bushing and straddling the rectangular hole 85. Each leg 89 is formed with two notches 94. When the link is assembled with the bushing, the leg 89 lies between the fingers 93 while the fingers project into the notches 94. As a result, the link is securely held against rotation relative to the bushing.

We claim:

1. A hinge for mounting a closure member for swinging between open and closed positions on a fixed member, said hinge comprising a closure bracket and a fixed bracket adapted to be attached to said closure member and said fixed member, respectively, a first link having one end portion connected pivotably to said fixed bracket to swing about a predetermined first axis which is fixed in space, first means connecting the opposite end portion of said first link slidably and pivotably to said closure bracket, a second link having a first end portion connected pivotably to said closure bracket to turn about a predetermined second axis relative to said closure bracket, second means connecting the opposite end portion of said second link slidably and pivotably to said fixed bracket, third means located between the end portions of said links and pivotably interconnecting said links to turn relative to one another about a third predetermined axis, said first means comprising a first slot formed in said closure bracket and slidably receiving a pivot on said first link, said first slot having a portion curved about a point which, in the closed position of said closure member, is located between said third axis and said opposite end portions of said links and lies in a plane disposed substantially between the interface of said closure member and said fixed member, said second means comprising a second slot formed in said fixed bracket and slidably receiving a pivot on said second link, said second slot being substantially straight and extending substantially parallel to a line which extends between said second axis and said third axis when said closure member is in said closed position.

2. A hinge as defined in claim 1 further including a contractile spring stretched between said fixed bracket and said first link and acting to urge said closure member from said open position toward said closed position.

3. A hinge as defined in claim 1 in which each of said pivots includes a bushing mounted slidably and rotatably in the respective slot and made of antifriction material, each bushing having an axially extending hole formed therethrough, each pivot further including a connector formed integrally with the end of the respective link, each of said connectors being generally S-shaped and having first and second legs lying against opposite faces of the bushing, each of said connectors also having a bridge formed integrally with said legs and extending through the hole in said bushing.

4. A hinge as defined in claim 3 further including means formed integrally with one of the faces of each bushing and engaging the adjacent leg of the associated connector to prevent the connector from turning relative to the bushing.

5. A hinge as defined in claim 4 in which the hole of each bushing and the bridge of each connector are of a non-circular cross-section in order to restrict rotation of the bridge within the hole.

6. A hinge for mounting a closure member on a fixed member to swing downwardly and outwardly relative to the fixed member from an upright closed position to an open position, said hinge comprising a closure bracket and a fixed bracket adapted to be attached to said closure member and said fixed member, respectively, a first elongated link having a lower end portion connected pivotably to the lower end portion of said fixed bracket to swing about a first horizontal axis which is fixed in space, first means connecting the upper end portion of said first link to slide upwardly and downwardly relative to said closure bracket and to turn relative to the closure bracket about a second generally horizontal axis, a second link having a lower end portion connected pivotably to said closure bracket to turn about a third generally horizontal axis relative to said closure bracket, second means connecting the upper end portion of said second link to slide upwardly and downwardly relative to said fixed bracket and to turn relative to said fixed bracket about a fourth generally horizontal axis, third means located between the upper and lower end portions of said links and pivotably interconnecting said links to turn relative to one another about a fifth generally horizontal axis, said first means comprising a first slot formed in said closure bracket and slidably receiving a pivot on the upper end portion of said first link, said first slot having a portion curved about a point which, in the closed position of said closure member, is disposed at the intersection of (a) an upright plane located substantially between the interface of said closure member and said fixed member, and (b) a horizontal plane located between said fifth axis and said second and fourth axes, said second means comprising a second slot formed in said fixed bracket and slidably receiving a pivot on the upper end portion of said second link, said second slot being substantially straight, being vertically inclined so as to slope outwardly upon progressing downwardly and extending substantially parallel to a line which extends between said third and fifth axes when said closure member is in said closed position.

7. A hinge as defined in claim 6 in which the radius of the curved portion of said first slot is approximately equal to one-fourth the straight line distance between said first and second axes.

8. A hinge as defined in claim 6 in which said first slot includes a straight portion which is located adjacent the lower end of said curved portion of said first slot when said closure member is in said closed position, the straight portion of said first slot extending substantially parallel to said second slot when said closure member is in said closed position.

9. A hinge as defined in claim 7 in which the pivot at the upper end of said first link travels in said first slot through a distance which is approximately twice as great as the distance through which the pivot at the upper end of said second link travels in said second slot when said closure member is moved from a fully closed position to a fully open position.

* * * * *